US008887443B2

(12) United States Patent
Horibe et al.

(10) Patent No.: US 8,887,443 B2
(45) Date of Patent: Nov. 18, 2014

(54) WINDOW REGULATOR

(75) Inventors: Atsushi Horibe, Fujisawa (JP); Takeshi Nishikawa, Fujisawa (JP)

(73) Assignee: Shiroki Corporation, Fujisawa-Shi, Kanagawa (JP)

( * ) Notice: Subject to any disclaimer, the term of this patent is extended or adjusted under 35 U.S.C. 154(b) by 0 days.

(21) Appl. No.: 13/990,616

(22) PCT Filed: Nov. 29, 2011

(86) PCT No.: PCT/JP2011/077499

§ 371 (c)(1),
(2), (4) Date: May 30, 2013

(87) PCT Pub. No.: WO2012/073945

PCT Pub. Date: Jun. 7, 2012

(65) Prior Publication Data

US 2013/0255157 A1 Oct. 3, 2013

(30) Foreign Application Priority Data

Nov. 30, 2010 (JP) ..... 2010-265844

(51) Int. Cl.
*E05F 11/44* (2006.01)

(52) U.S. Cl.
CPC ..... *E05F 11/44* (2013.01); *E05Y 2800/674* (2013.01); *E05F 11/445* (2013.01); *E05Y 2900/55* (2013.01)
USPC ..... 49/351; 49/349

(58) Field of Classification Search
USPC ..... 49/348, 349, 350, 351, 502
See application file for complete search history.

(56) References Cited

U.S. PATENT DOCUMENTS

| | | | | | |
|---|---|---|---|---|---|
| 2,409,068 | A | * | 10/1946 | Roethel | 74/89.19 |
| 3,231,301 | A | * | 1/1966 | Gray | 403/164 |
| 3,897,652 | A | * | 8/1975 | Hess | 49/351 |
| 4,120,120 | A | * | 10/1978 | Becker | 49/351 |
| 4,414,779 | A | * | 11/1983 | Ishii | 49/351 |

(Continued)

FOREIGN PATENT DOCUMENTS

| | | | |
|---|---|---|---|
| JP | H06-013984 | | 4/1994 |
| JP | 11-210319 | A | 8/1999 |
| JP | 2000-192727 | A | 7/2000 |
| JP | 2003-321970 | A | 11/2003 |

OTHER PUBLICATIONS

International Search Report in PCT/JP2011/077499, dated Dec. 27, 2011 (English Translation Thereof).

(Continued)

*Primary Examiner* — Katherine Mitchell
*Assistant Examiner* — Justine Rephann
(74) *Attorney, Agent, or Firm* — McGinn IP Law Group, PLLC

(57) ABSTRACT

An X arm type window regulator includes a lift arm, a lift arm bracket, an equalizer arm, and an equalizer arm bracket. The window regulator opens and closes window glass through pivotal movement of the lift arm. The lift arm has two stress-dispersing elongated protrusions provided in respective regions which are located in the vicinity of an annular protrusion provided around a through hole formed in a central portion thereof, the regions being located on the side toward a proximal end portion of the lift arm and located toward two respective edges of the lift arm. The stress-dispersing elongated protrusions have a function of dispersing stress caused by a load imposed on the distal end portion of the lift arm.

8 Claims, 4 Drawing Sheets

(56) References Cited

U.S. PATENT DOCUMENTS

| | | | | |
|---|---|---|---|---|
| 4,986,029 | A * | 1/1991 | Richter | 49/349 |
| 4,998,379 | A * | 3/1991 | Yamada et al. | 49/138 |
| 5,255,470 | A * | 10/1993 | Dupuy | 49/227 |
| 5,392,563 | A * | 2/1995 | Cardine | 49/351 |
| 5,595,025 | A * | 1/1997 | MacPhail-Fausey | 49/351 |
| 6,003,268 | A * | 12/1999 | Oruganty | 49/351 |
| 6,041,549 | A * | 3/2000 | Schust et al. | 49/375 |
| 6,052,945 | A * | 4/2000 | Asada et al. | 49/351 |
| 6,279,269 | B1 | 8/2001 | Isomura et al. | |
| 6,513,285 | B2 * | 2/2003 | Isomura | 49/351 |
| 6,912,811 | B2 * | 7/2005 | Kawashima et al. | 49/351 |
| 7,017,303 | B2 * | 3/2006 | Cho | 49/351 |
| 7,739,837 | B2 * | 6/2010 | Suzuki et al. | 49/351 |
| 7,997,029 | B2 * | 8/2011 | Kim | 49/351 |
| 8,125,100 | B2 * | 2/2012 | Suzuki et al. | 307/9.1 |
| 8,418,405 | B2 * | 4/2013 | Yoshida et al. | 49/351 |
| 8,516,745 | B2 * | 8/2013 | Fujisaki et al. | 49/351 |
| 2010/0005725 | A1 * | 1/2010 | Nagai et al. | 49/407 |
| 2010/0024306 | A1 * | 2/2010 | Staser | 49/349 |
| 2011/0314740 | A1 * | 12/2011 | Mori et al. | 49/349 |
| 2013/0025208 | A1 * | 1/2013 | Nagai et al. | 49/350 |
| 2013/0232879 | A1 * | 9/2013 | Anderson | 49/348 |

OTHER PUBLICATIONS

PCT/ISA/237 ( English translation of written opinion of the international searching authority, dated Dec. 27, 2011).
PCT/IB/373.

* cited by examiner 1
11
12
13
14
15
15a
16
181(18)
C
D
E
F
G

WINDOW REGULATOR

TECHNICAL FIELD

The present invention relates to a so-called X arm type window regulator having a lift arm and an equalizer arm and adapted to open and close, through pivotal movement of the lift arm, window glass which is supported by the lift arm via a lift arm bracket. More particularly, the present invention relates to a window regulator in which the shape of the lift arm is improved so as to disperse stress caused by a load which is applied to the lift arm through a distal end portion of the lift arm.

BACKGROUND ART

A conventionally provided X arm type window regulator is configured as follows: a lift arm and an equalizer arm are pivotally connected to each other in an X-shaped manner; and window glass which is supported by the lift arm via a lift arm bracket is opened and closed through pivotal movement of the lift arm.

Japanese Patent Application Laid-Open No. 2003-321970 (Patent Document 1) discloses an X arm type window regulator in which a plug plate located at a central portion of an equalizer arm is fitted into a through hole located at a central portion of a lift arm, thereby pivotally connecting the arms to each other. The plug plate is a flat circular columnar plate for joining, at the central portion of the equalizer arm, a first arm and a second arm which partially constitute the equalizer arm. An end portion of the first arm is welded to one end surface of the plug plate, and an end portion of the second arm is welded to the other end surface of the plug plate, whereby the first arm and the second arm are joined together.

In the window regulator of Japanese Patent Application Laid-Open No. 2003-321970, in order to establish smooth relative pivotal movement between the lift arm and the equalizer arm at a pivotal connection of the arms without generation of play and unusual noise, one of the arms has a protrusion provided on its surface which faces the other arm, in such a manner as to protrude toward the other arm. By virtue of this, an appropriate clearance is ensured between the lift arm and the equalizer arm without influence of dimensional variations of component parts which arise in the course of manufacture.

PRIOR ART DOCUMENT

Patent Document

Patent Document 1:

Japanese Patent Application Laid-Open No. 2003-321970

SUMMARY OF THE INVENTION

Problems to be Solved by the Invention

In order to meet demand for reduction in weight, the X arm type window regulator has been desired to reduce the thickness of its members, such as the lift arm. Also, demand exists to reduce the size of the members.

On the other hand, the X arm type window regulator is required to have sufficient strength to prevent the occurrence of buckling or excessive curvature of the lift arm which could otherwise result from exposure to load from window glass when the window glass reaches a fully-closed position or a fully-opened position. That is, the lift arm of the X arm type window regulator is required to have sufficient torsional rigidity about the longitudinal axis.

An object of the present invention is to provide a window regulator which satisfies the competing requirements for reduction in weight and thickness and provision of sufficient torsional rigidity.

Means for Solving the Problems

The present invention is configured as mentioned below in [1] to [7]. Reference numerals appearing in the present section (MEANS FOR SOLVING THE PROBLEMS) and in the next section (EFFECTS OF THE INVENTION) are provided for convenience of understanding and should not be construed as limiting the invention.

[1] Configuration 1

A window regulator comprising:

a lift arm 1 whose proximal end portion 11 is rotatably supported and whose distal end portion 12 is guided by a guide 51 of a lift arm bracket 5 extending in a direction intersecting with a direction of opening and closing window glass, and an equalizer arm 2 whose middle portion 23 is pivotally fitted into a through hole 13 formed in a central portion of the lift arm 1 in such a manner that the equalizer arm 2 and the lift arm 1 form a shape resembling a letter X, whose distal end portion 22 supports the lift arm bracket 5, and whose proximal end portion 21 is guided by a guide 61 of an equalizer arm bracket 6 parallel to the guide 51 of the lift arm bracket 5, the lift arm 1 moving pivotally to open and close the window glass supported by the lift arm bracket 5, wherein the lift arm 1 has a stress-dispersing protrusion 18 formed in a region located in the vicinity of the through hole 13 of the lift arm 1 and on a side toward the proximal end portion 11.

The stress-dispersing protrusion 18 yields a function of dispersing stress caused by a load which is applied from the window glass to the distal end portion 12 of the lift arm 1 via the lift arm bracket 5.

When the lift arm 1 is formed by, for example, press forming, the stress-dispersing protrusion 18 can be formed simultaneously with the through hole 13, etc. When press forming is employed, the stress-dispersing protrusion 18 is "recessed" as viewed on the opposite side of the lift arm 1.

The stress-dispersing protrusion 18 may appear in a "protruding" manner on either side of the lift arm 1, so long as the stress-dispersing protrusion 18 is provided in such a manner as to avoid interference between the lift arm 1 and the equalizer arm 2 when the equalizer arm 2 pivotally moves relative to the lift arm 1 (when window glass opens/closes).

Generally, the equalizer arm 2 comprises a first arm 2A located on a side toward the proximal end portion 21, a second arm 2B located on a side toward the distal end portion 22, and a plug plate 2C located at the middle portion 23. The plug plate 2C has a short (low-profile) circular columnar shape. The first arm 2A and the second arm 2B are fixed to each other via the plug plate 2C. The equalizer arm 2 is pivotally connected to the lift arm 1; specifically, the plug plate 2C of the equalizer arm 2 is pivotally connected to the through hole 13 of the lift arm 1.

[2] Configuration 2

In the window regulator according to configuration 1, the lift arm 1 has an annular protrusion 14 formed around the through hole 13 formed in the central portion thereof and has a longitudinally elongated planar protrusion 15 formed at a laterally central portion thereof between the annular protrusion 14 and the proximal end portion 11 thereof and extending in a longitudinal direction from a proximal vicinity of the annular protrusion 14 toward the proximal end portion 11, and the stress-dispersing protrusion 18 is formed at least in a region between the annular protrusion 14 and a distal end of the longitudinally elongated planar protrusion 15.

The expression "the stress-dispersing protrusion 18 is formed at least in a region between the annular protrusion 14 and a distal end of the longitudinally elongated planar protrusion 15" means that, with respect to the longitudinal direction of the lift arm 1:

(1) the stress-dispersing protrusion 18 exists between the annular protrusion 14 and the distal end of the longitudinally elongated planar protrusion 15;

(2) the stress-dispersing protrusion 18 exists between the annular protrusion 14 and the distal end of the longitudinally elongated planar protrusion 15 and extends to a region which overlaps with a part of the annular protrusion 14;

(3) the stress-dispersing protrusion 18 exists between the annular protrusion 14 and the distal end of the longitudinally elongated planar protrusion 15 and extends to a region which overlaps with the distal end of the longitudinally elongated planar protrusion 15; or (4) the stress-dispersing protrusion 18 exists between the annular protrusion 14 and the distal end of the longitudinally elongated planar protrusion 15 and extends to a region which overlaps with a part of the annular protrusion 14 and to a region which overlaps with the distal end of the longitudinally elongated planar protrusion 15.

The annular protrusion 14 and the stress-dispersing protrusion 18 may appear in a "protruding" manner on the same side or on different sides of the lift arm 1, so long as the annular protrusion 14 and the stress-dispersing protrusion 18 are provided in such a manner as to avoid interference between the lift arm 1 and the equalizer arm 2 when the equalizer arm 2 pivotally moves relative to the lift arm 1 (when window glass opens/closes). Also, the annular protrusion 14, the longitudinally elongated planar protrusion 15, and the stress-dispersing protrusion 18 may all appear in a "protruding" manner on the same side of the lift arm 1 or may appear in a "protruding" manner on different sides of the lift arm 1.

[3] Configuration 3

In the window regulator according to configuration 2, the stress-dispersing protrusion 18 has at least a part being extended to a range overlapped, in a longitudinal direction of the lift arm 1, with the annular protrusion 14, or to a range overlapped, in a longitudinal direction of the lift arm 1, with the distal end of the longitudinally elongated planar protrusion 15.

[4] Configuration 4

In the window regulator according to any one of configurations 1 to 3, the stress-dispersing protrusion 18 is formed in at least one of regions in the vicinity of the through hole 13 of the lift arm 1, the regions being located on the side toward the proximal end portion 11 and located toward opposite edges 16 of the lift arm 1.

The expression "the stress-dispersing protrusion 18 is formed in at least one of regions in the vicinity of the through hole 13 of the lift arm 1, the regions being located on the side toward the proximal end portion 11 and located toward opposite edges 16 of the lift arm 1" means that:

(1) the stress-dispersing protrusion 18 is formed in a region located toward one edge 16 of the lift arm 1;

(2) the stress-dispersing protrusion 18 is formed in each of two regions located toward two respective edges 16, 16;

(3) the stress-dispersing protrusion 18 is formed in a region located toward one edge 16 of the lift arm 1 and is also formed in a region which is located along an imaginary longitudinal centerline of the lift arm 1 in the vicinity of the through hole 13 formed in the central portion of the lift arm 1, on the side toward the proximal end portion 11; or (4) the stress-dispersing protrusion 18 is formed in each of two regions located toward two respective edges 16, 16 and is also formed in a region which is located along the imaginary longitudinal centerline of the lift arm 1 in the vicinity of the through hole 13 formed in the central portion of the lift arm 1, on the side toward the proximal end portion 11.

In the case where a plurality of the stress-dispersing protrusions 18 are provided, the stress-dispersing protrusions 18 may appear in a "protruding" manner on the same side or on different sides of the lift arm 1, so long as the stress-dispersing protrusions 18 are provided in such a manner as to avoid interference between the lift arm 1 and the equalizer arm 2 when the equalizer arm 2 pivotally moves relative to the lift arm 1 (when window glass opens/closes).

[5] Configuration 5

In the window regulator according to any one of configurations 1 to 4, the stress-dispersing protrusion 18 is a stress-dispersing elongated protrusion 181 (181A) which extends linearly, and/or a planar stress-dispersing protrusion 185 (185A) having a flat shape.

[6] Configuration 6

In the window regulator according to configuration 5, one end of the stress-dispersing protrusion 18 is connected to the annular protrusion 14.

[7] Configuration 7

In the window regulator according to any one of configurations 1 to 4, the stress-dispersing protrusion has at least one stress-dispersing elongated protrusion being extended rectilinearly oblique direction in such a manner that one end thereof is connected to the annular protrusion, whereas the other end thereof reaches the edge of the lift arm.

Effects of the Invention

The configuration 1 is a window regulator which comprises the lift arm 1 whose proximal end portion 11 is rotatably supported and whose distal end portion 12 is guided by the guide 51 of the lift arm bracket 5 extending in a direction intersecting with the direction of opening and closing window glass, and the equalizer arm 2 whose middle portion 23 is pivotally fitted into the through hole 13 formed in a central portion of the lift arm 1 in such a manner that the equalizer arm 2 and the lift arm 1 form a shape resembling the letter X, whose distal end portion 22 supports the lift arm bracket 5, and whose proximal end portion 21 is guided by the guide 61 of the equalizer arm bracket 6 parallel to the guide 51 of the lift arm bracket 5; the lift arm 1 moves pivotally to open and close the window glass supported by the lift arm bracket 5; and the lift arm 1 has the stress-dispersing protrusion 18 formed in a region which is located in the vicinity of the through hole 13 of the lift arm 1 and on a side toward the proximal end portion 11. Thus, the stress-dispersing protrusion 18 yields a function of dispersing stress caused by a load imposed on the distal end portion of the lift arm. As a result, even though the lift arm 1 is reduced in thickness, the lift arm 1 can have sufficient torsional rigidity. Therefore, the present invention can provide a window regulator which is light and has sufficient torsional rigidity.

The configuration 2 is a window regulator according to configuration 1, wherein the lift arm 1 has the annular protrusion 14 formed around the through hole 13 formed in the central portion thereof and has the longitudinally elongated planar protrusion 15 formed at a laterally central portion thereof between the annular protrusion 14 and the proximal end portion 11 thereof and extending in the longitudinal direction from the proximal vicinity of the annular protrusion 14 toward the proximal end portion 11, and the stress-dispersing protrusion 18 is formed at least in a region between the annular protrusion 14 and the distal end of the longitudinally elongated planar protrusion 15. Thus, in addition to the effect of configuration 1, there is yielded a synergistic effect that torsional rigidity provided by the stress-dispersing protrusion 18 reinforces torsional rigidity provided by the annular protrusion 14 and the longitudinally elongated planar protrusion 15.

The configuration 3 is a window regulator according to configuration 2, wherein the stress-dispersing protrusion 18 has at least a part being extended to a range overlapped, in a longitudinal direction of the lift arm 1, with the annular protrusion 14, or to a range overlapped, in a longitudinal direction of the lift arm 1, with the distal end of the longitudinally elongated planar protrusion 15. Thus, in addition to the effect of configuration 1 or 2, there is yielded a synergistic effect that torsional rigidity provided by the stress-dispersing protrusion 18 further reinforces torsional rigidity provided by the annular protrusion 14 and the longitudinally elongated planar protrusion 15.

The configuration 4 is a window regulator according to configuration any one of configurations 1 to 3, wherein the stress-dispersing protrusion 18 is formed in at least one of regions in the vicinity of the through hole 13 of the lift arm 1, the regions being located on the side toward the proximal end portion 11 and located toward opposite edges 16 of the lift arm 1. Thus, in addition to the effects of configurations 1 and 2, there is yielded an effect that the stress-dispersing protrusion 18 can be provided in a specific region where the stress-dispersing protrusion 18 can yield a stress dispersing function.

The configuration 5 is a window regulator according to any one of configurations 1 to 4, wherein the stress-dispersing protrusion 18 is the stress-dispersing elongated protrusion 181 which extends linearly, and/or the planar stress-dispersing protrusion 185 having a flat shape. Thus, in addition to the effects of configurations 1 to 3, there is yielded an effect that the stress-dispersing protrusion 18 can have a specific shape for yielding the stress dispersing function.

The configuration 6 is a window regulator according to configuration 5, wherein one end of the stress-dispersing protrusion 18 is connected to the annular protrusion 14. Thus, in addition to the effect of configuration 4, there is yielded an effect that the stress-dispersing protrusion 18 can have a specific shape, in relation to the annular protrusion 14, suited for yielding an enhanced stress dispersing function.

BRIEF DESCRIPTION OF THE DRAWINGS

FIGS. 1A and 1B are views showing an window regulator according to an embodiment of the present invention, wherein FIG. 1A is a front view, and FIG. 1B is a schematic sectional view taken along line B-B of FIG. 1A;

FIGS. 2A to 2H are views showing a lift arm of the window regulator shown in FIGS. 1A and 1B, wherein FIG. 2A is a perspective view, FIG. 2B is a front view, FIGS. 2C to 2G are sectional views taken along lines C-C, D-D, E-E, F-F, and G-T, respectively, of FIG. 2B, and FIG. 2H is a top view;

FIGS. 4A, 4C, and 4E are perspective views showing specific examples of other stress-dispersing protrusions different from those shown in FIGS. 1A and 1B, FIGS. 2A to 2H, and FIGS. 3A to 3J, wherein

MODE FOR CARRYING OUT THE INVENTION

An embodiment of the present invention will be described in detail with reference to the drawings. In the following description, the terms "protrusion," "elongated protrusion," and "planar protrusion" are of relative expressions. A protrusion, an elongated protrusion, and a planar protrusion are a recess, an elongated recess, and a planar recess, respectively, as viewed from the opposite side.

(1) Outline of Example Shown in FIGS. 1A and 1B and FIGS. 2A to 2H In an example shown in FIGS. 1A and 1B and FIGS. 2A to 2H, two stress-dispersing elongated protrusions 181, an annular protrusion 14, and a longitudinally elongated planar protrusion 15 "protrude" toward the near side of paper on which FIGS. 1A and 1B and FIGS. 2A to 2H appear.

Figure 1A:
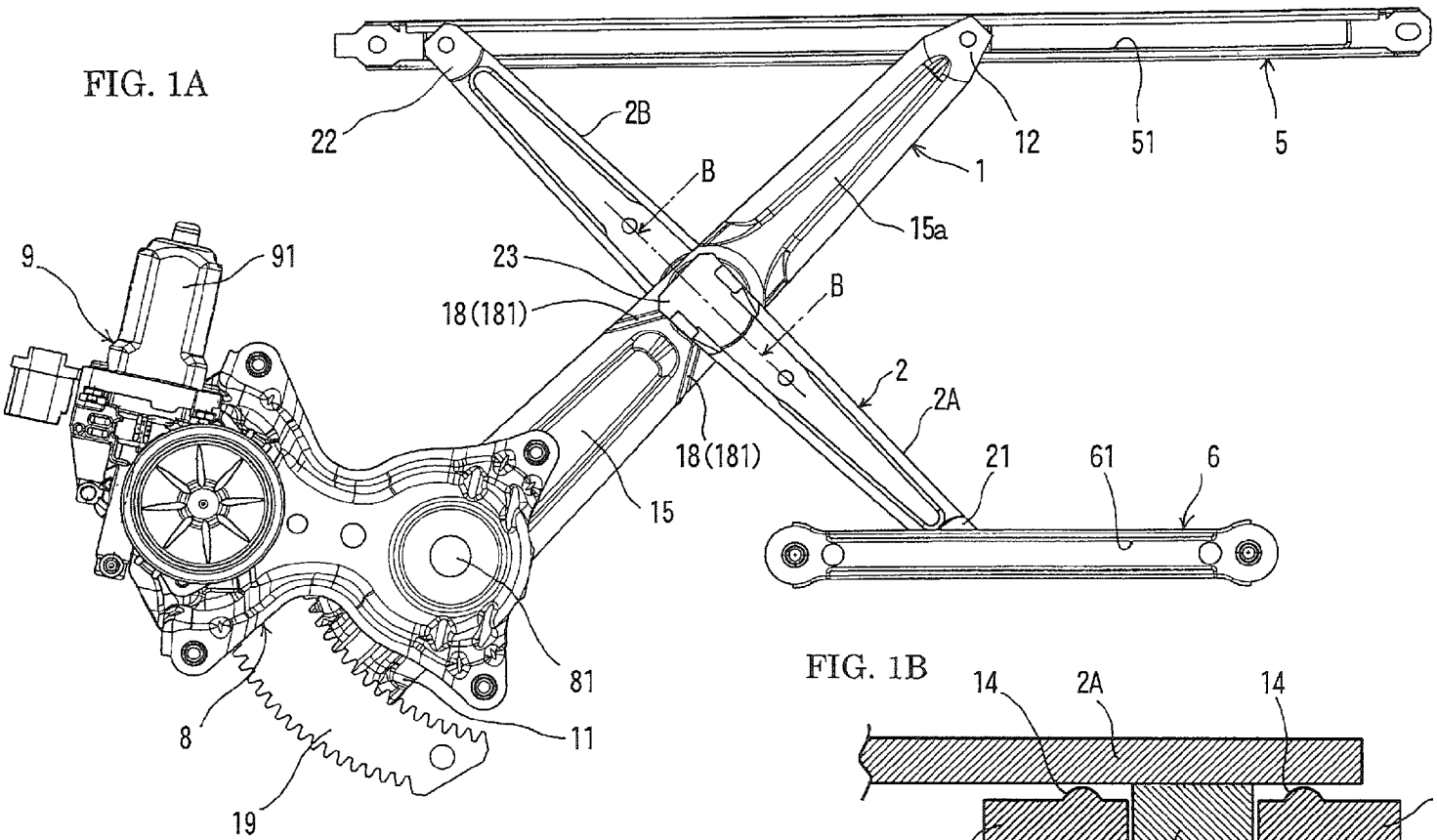
Figure 1B:
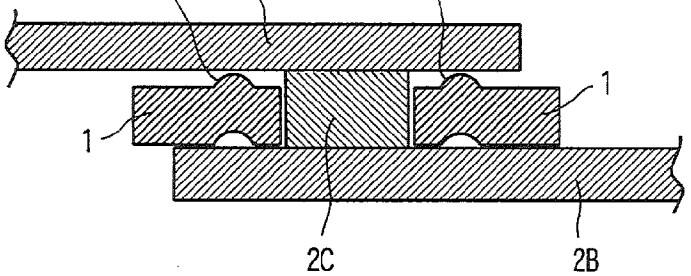
Figures 2A, 2B, 2C, 2D, 2E, 2F, 2G, 2H:
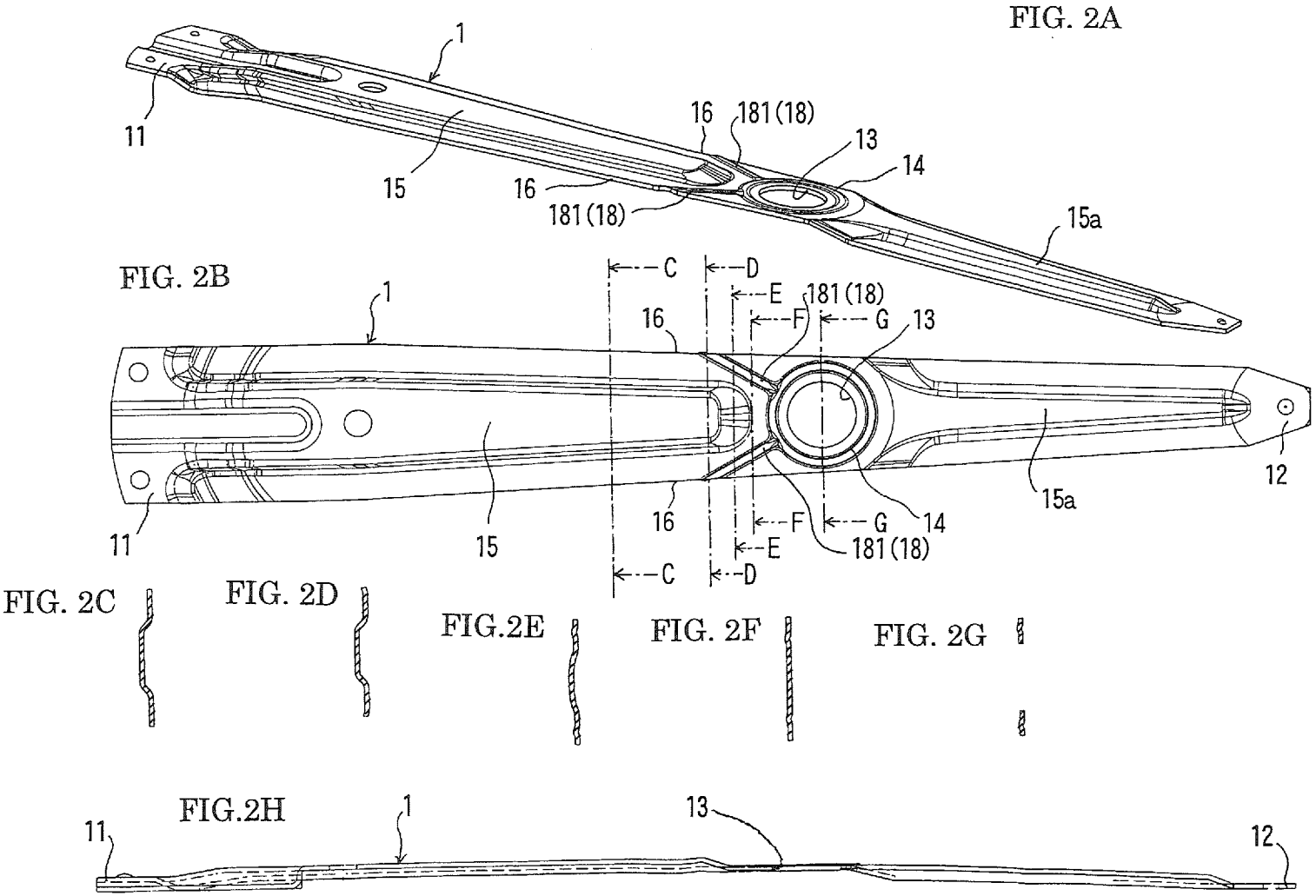

A so-called X arm type window regulator shown in FIGS. 1A and 1B has a lift arm 1, an equalizer arm 2, a lift arm bracket 5, an equalizer arm bracket 6, and a drive mechanism 9 having a motor 91. In the example shown in FIGS. 1A and 1B, a drive power source is the motor 91. However, instead of using the motor 91, a manual system may be employed.

The lift arm 1 made of metal is fixedly attached, at its proximal end portion 11, to a driven gear 19. A shaft 81 is a pivot of the driven gear 19 and also serves as a pivot of the lift arm 1. The lift arm 1 and the driven gear 19, which are fixedly attached to each other, are rotatably attached to a base plate 8 by means of the shaft 81. A drive mechanism 9 is fixedly attached to the base plate 8. The drive mechanism 9 has the motor 91 and a transmission gear mechanism (not shown) for transmitting drive force of an output shaft (not shown) of the motor 91 to the driven gear 19. Since a mechanism for pivotally moving the lift arm 1 by the drive mechanism 9 is well known, further description thereof is omitted.

A middle portion 23 of the equalizer arm 2 is pivotally connected to a longitudinally central portion of the lift arm 1 in a crossing manner, whereby the lift arm 1 and the equalizer arm 2 form a shape resembling "the letter X."

The equalizer arm 2 is engaged, at its distal end portion 22, with a guide 51 of the lift arm bracket 5, whereby the distal end portion 22 is guided by the guide 51 and supports the lift arm bracket 5. Also, the equalizer arm 2 is engaged, at its proximal end portion 21, with a guide 61 of the equalizer arm bracket 6, whereby the proximal end portion 21 is guided by the guide 61.

The equalizer arm 2 has a first arm 2A, a second arm 2B, and a plug plate 2C, which are fixedly joined together.

The first arm 2A is a member extending from the proximal end portion 21 to the middle portion 23 and is located above the lift arm 1 in FIGS. 1A and 1B. The second arm 2B is a member extending from the middle portion 23 to the distal end portion 22 and is located under the lift arm 1 in FIGS. 1A and 1B. The plug plate 2C has a low-profile circular columnar shape. As viewed in FIGS. 1A and 1B, an end portion of the first arm 2A located toward the middle portion 23 is welded to the upper end surface of the plug plate 2C, and an end portion of the second arm 2B located toward the middle portion 23 is welded to the lower end surface of the plug plate 2C. In this manner, the first arm 2A, the plug plate 2C, and the second arm 2B are joined together.

The plug plate 2C is inserted into a through hole 13 formed in a longitudinally central portion of the lift arm 1, whereby the equalizer arm 2 and the lift arm 1 are pivotally connected together. This feature is schematically shown in FIG. 1B.

The lift arm bracket 5 is a member for supporting window glass (not shown) from underneath (as viewed in a state of being mounted to an automobile). The lift arm bracket 5 has the guide 51 extending in a direction intersecting with the direction of opening and closing window glass (vertical direction). A distal end portion 12 of the lift arm 1 is engaged with the guide 51 and moves along the guide 51 as the lift arm 1 moves pivotally (as window glass is raised and lowered).

The equalizer arm bracket 6 is a member which slidably supports the proximal end portion 21 of the equalizer arm 2. The equalizer arm bracket 6 has the guide 61 extending in a direction parallel to the guide 51 of the lift arm bracket 5. The proximal end portion 21 of the equalizer arm 2 is engaged with the guide 61 and moves along the guide 61 as the equalizer arm 2 pivotally moves in association with the pivotal movement of the lift arm 1 (vertical movement of window glass).

The above-mentioned equalizer arm bracket 6 and the base plate 8 are mounted in a predetermined region behind a door panel of an automobile, whereby the window regulator is disposed behind the door panel.

(2) Shape of Lift Arm Shown in FIGS. 1A and 1B and FIGS. 2A to 2H The shape of the lift arm 1 will be described with reference to FIGS. 1A and 1B and FIGS. 2A to 2H.

The lift arm 1 has the circular through hole 13 formed in a longitudinally central portion thereof and the annular protrusion 14 formed around the through hole 13. The annular protrusion 14 provides a sliding surface between the equalizer arm 2 and the lift arm 1 when the equalizer arm 2 pivotally moves relative to the lift arm 1. As mentioned above, the plug plate 2C of the equalizer arm 2 is pivotally inserted into the through hole 13.

The lift arm 1 has the longitudinally elongated planar protrusion 15 formed at a laterally central portion thereof between the annular protrusion 14 and the proximal end portion 11 thereof and extending in the longitudinal direction from the proximal vicinity of the annular protrusion 14 toward the proximal end portion 11. The term "proximal vicinity" means a region located at the left of and slightly away from the annular protrusion 14 in FIG. 2B. The slight spacing from the annular protrusion 14 associated with the proximal vicinity is provided for avoiding interference between the lift arm 1 and the equalizer arm 2 when the equalizer arm 2 pivotally moves relative to the lift arm 1.

Similarly, the lift arm 1 has a longitudinally elongated planar protrusion 15*a* formed at a laterally central portion thereof between the annular protrusion 14 and the distal end portion 12 thereof and extending in the longitudinal direction from the distal vicinity of the annular protrusion 14 toward the distal end portion 12. The term "distal vicinity" means a region located at the right of and slightly away from the annular protrusion 14 in FIG. 2B. The slight spacing from the annular protrusion 14 associated with the distal vicinity is also provided for avoiding interference between the lift arm 1 and the equalizer arm 2 when the equalizer arm 2 pivotally moves relative to the lift arm 1.

The longitudinally elongated planar protrusions 15 and 15*a* are provided for enhancing torsional rigidity of the lift arm 1. When the lift arm 1 is formed by press forming, the longitudinally elongated planar protrusions 15 and 15*a* are formed simultaneously with the through hole 13, the annular protrusion 14, as well as stress-dispersing protrusions 18 (181, 181), which are described below.

In the example shown in FIGS. 1A and 1B and FIGS. 2A to 2H, in addition to the annular protrusion 14 and the longitudinally elongated planar protrusions 15 and 15*a*, two stress-dispersing elongated protrusions 181, which serve as the stress-dispersing protrusions 18, are formed in respective regions located in the vicinity of the through hole 13 on a side toward the proximal end portion 11. Specifically, the two stress-dispersing elongated protrusions 181 are formed as follows: the stress-dispersing elongated protrusions 181 extend obliquely from the annular protrusion 14 around the through hole 13 on a side toward the proximal end portion 11 in such a manner that one ends thereof are connected to the annular protrusion 14, whereas the other ends thereof reach respective edges 16 of the lift arm 1.

When the two stress-dispersing elongated protrusions 181, 181 are viewed from a direction orthogonal to the longitudinal direction of the lift arm 1 (as viewed from above the paper on which FIG. 2H appears), the one ends thereof connected to the annular protrusion 14 overlaps with the annular protrusion 14, and the other ends thereof which reach the edges 16 overlap with a distal end portion of the longitudinally elongated planar protrusion 15. By virtue of the existence of such overlaps, torsional rigidity is further enhanced.

Such formation of the stress-dispersing elongated protrusions 181 yields the following effect. When window glass is raised and comes into contact with a glass seal member (not shown) or when window glass is lowered and comes into contact with a stopper member (not shown), reaction force from the glass seal member or the stopper member imposes a load on the distal end portion 12 of the lift arm 1 via the lift arm bracket 5. However, stress caused by the load is favorably dispersed by means of the stress-dispersing elongated protrusions 181, 181. Thus, even though the thickness of the lift arm 1 is thin, the lift arm 1 can sufficiently endure the stress.

(3) Examples shown in FIGS. 3A to 3J

FIGS. 3A to 3J show other examples of the stress-dispersing protrusion 18.

In the example shown in FIGS. 1A and 1B and FIGS. 2A to 2H, the two stress-dispersing protrusions 18 assume the form of the two stress-dispersing elongated protrusions 181, 181 which extend rectilinearly in respectively oblique directions in such a manner that one ends thereof are connected to the annular protrusion 14, whereas the other ends thereof reach the respective edges 16, 16 of the lift arm 1.

Figure 3A:
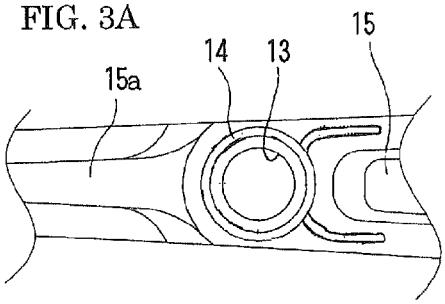
FIGS. 3A to 3J are front views showing specific examples of a stress-dispersing protrusion.
Figure 3B:
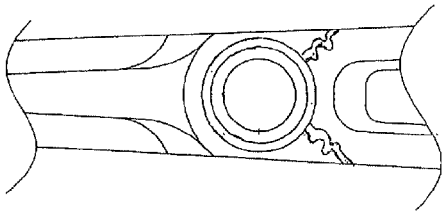
Figure 3C:
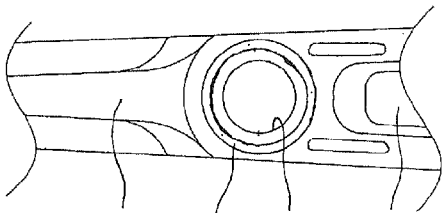
Figure 3D:
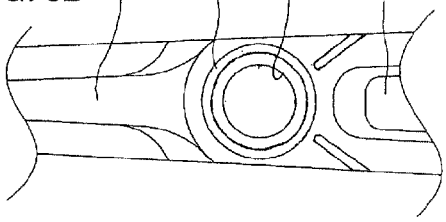
Figure 3E:
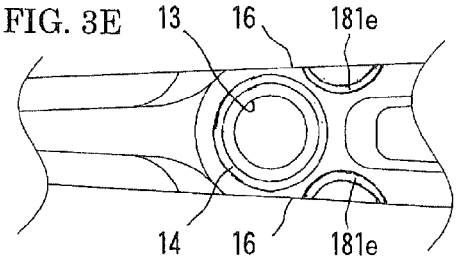

By contrast, in FIG. 3A, the two stress-dispersing elongated protrusions are connected at their one ends to the annular protrusion 14; extend in respectively oblique directions from the annular protrusion 14; and are then curved so as to extend in parallel with the edges 16. In FIG. 3B, the two stress-dispersing elongated protrusions are connected at their one ends to the annular protrusion 14 and extend zigzag in respectively oblique directions from the annular protrusion 14 such that their other ends reach the respective edges 16. In FIG. 3C, the two stress-dispersing elongated protrusions are separated from the annular protrusion 14 and extend in parallel with the edges 16 so that their ends do not reach the edges 16. In FIG. 3D, the two stress-dispersing elongated protrusions are separated at their one ends from the annular protrusion 14 and extend rectilinearly in respectively oblique directions in such a manner that their other ends reach the respective edges 16. In FIG. 3E, the two stress-dispersing elongated protrusions are separated from the annular protrusion 14 and are curved in such a manner that their opposite ends reach the edges 16, while their centers are located away from the edges 16.

Figure 3F:
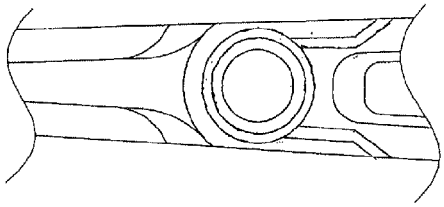
Figure 3G:
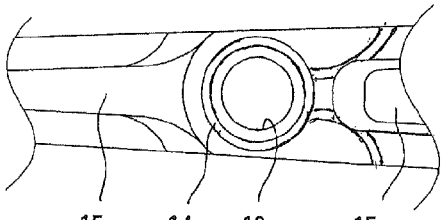
Figure 3H:
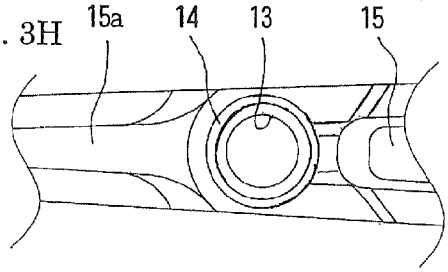
Figure 3I:
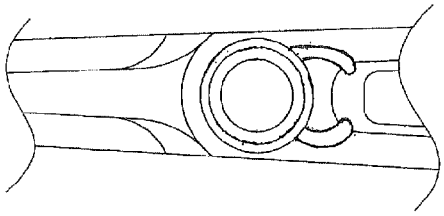
Figure 3J:
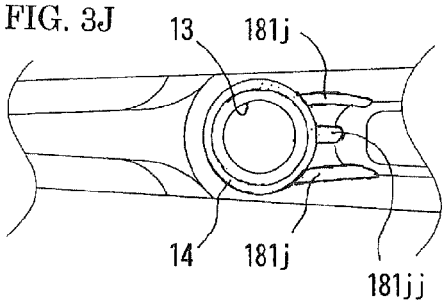

In FIG. 3F, the two stress-dispersing elongated protrusions are connected at their one ends to the annular protrusion 14;

extend from the annular protrusion 14 in parallel with the edges 16; and are bent and then extend such that their other ends reach the respective edges 16. In FIG. 3G, the two stress-dispersing elongated protrusions are connected at their one ends to the annular protrusion 14 and are curved in such a manner as to be substantially connected to respective distal end corners of the longitudinally elongated planar protrusion 15 and such that their other ends reach the respective edges 16. In FIG. 3H, the two stress-dispersing elongated protrusions are connected at their one ends to the annular protrusion 14; extend from the annular protrusion 14 in parallel with the edges 16 until the stress-dispersing elongated protrusions are substantially connected to respective distal end corners of the longitudinally elongated planar protrusion 15; and are bent at the distal end corners of the longitudinally elongated planar protrusion 15 so as to extend such that their other ends reach the respective edges 16. In FIG. 3I, the two stress-dispersing elongated protrusions are curved inward while their one ends are connected to the annular protrusion 14, and their other ends are connected to the distal end of the longitudinally elongated planar protrusion 15. In FIG. 3J, in addition to two stress-dispersing elongated protrusions 181*j* similar to those of FIG. 3I, but smaller in the degree of curvature, an elongated stress-dispersing protrusion 181*jj* is connected at its one end to the annular protrusion 14 and extends rectilinearly along the imaginary longitudinal centerline of the lift arm 1 such that its other end reaches the vicinity of the longitudinally elongated planar protrusion 15.

The stress-dispersing elongated protrusions shown in FIGS. 3A to 3J also yield a stress-dispersing function in a manner substantially similar to that of the stress-dispersing elongated protrusions shown in FIGS. 1A and 1B and FIGS. 2A to 2H.

(4) Examples shown in FIGS. 4A to 4F

FIGS. 4A to 4F show further examples of the stress-dispersing protrusion 18.

Figure 4A:
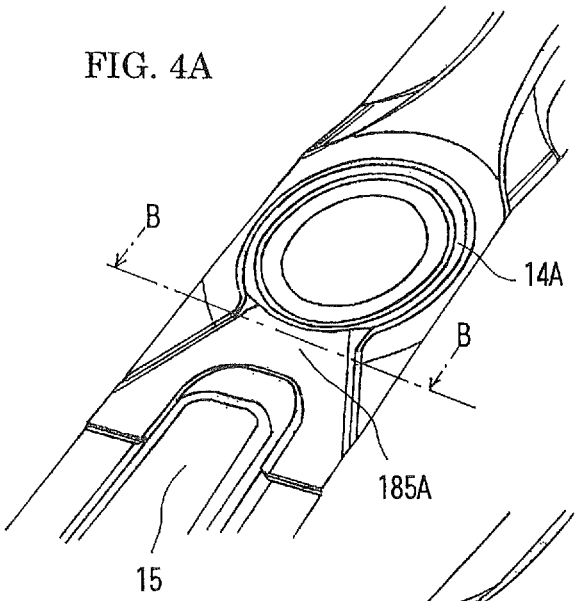
Figure 4B:
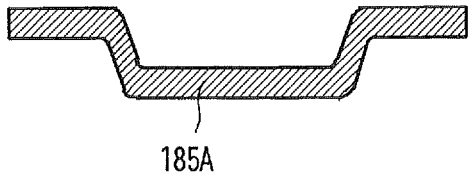
FIG. 4B is a schematic sectional view taken along line B-B of FIG. 4A.

In FIGS. 4A and 4B, a stress-dispersing planar protrusion 185A is formed at a laterally central portion of the lift arm 1 between an annular protrusion 14A and the longitudinally elongated planar protrusion 15. The letter "A" in the annular protrusion 14A and the stress-dispersing planar protrusion 185A means that they appear in a "protruding" manner on a side opposite the side on which the longitudinally elongated planar protrusion 15 appears in a protruding manner.

Figure 4C:
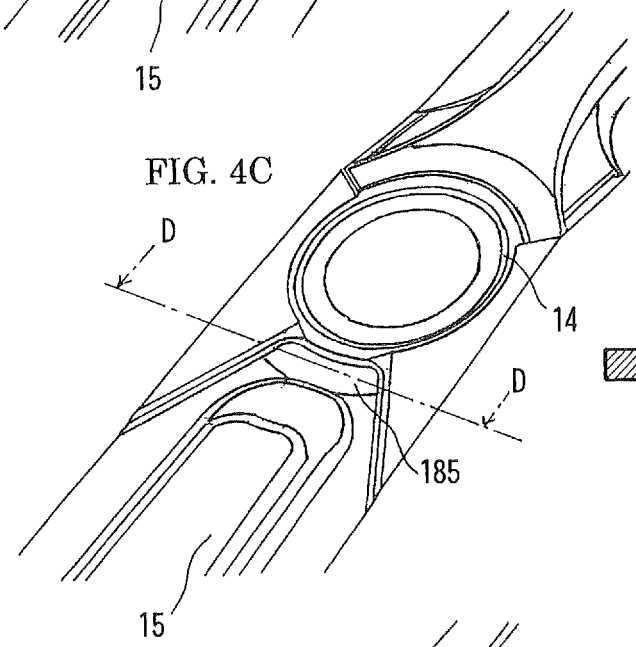
Figure 4D:
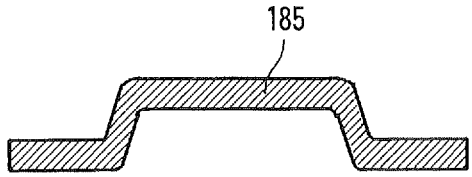
FIG. 4D is a schematic sectional view taken along line D-D of FIG. 4C.

In FIGS. 4C and 4D, a stress-dispersing planar protrusion 185 is formed at a laterally central portion of the lift arm 1 between the annular protrusion 14 and the longitudinally elongated planar protrusion 15. In this example, all of the annular protrusion 14, the longitudinally elongated planar protrusion 15, and the stress-dispersing planar protrusion 185 appear in a "protruding" manner on the same side.

Figure 4E:
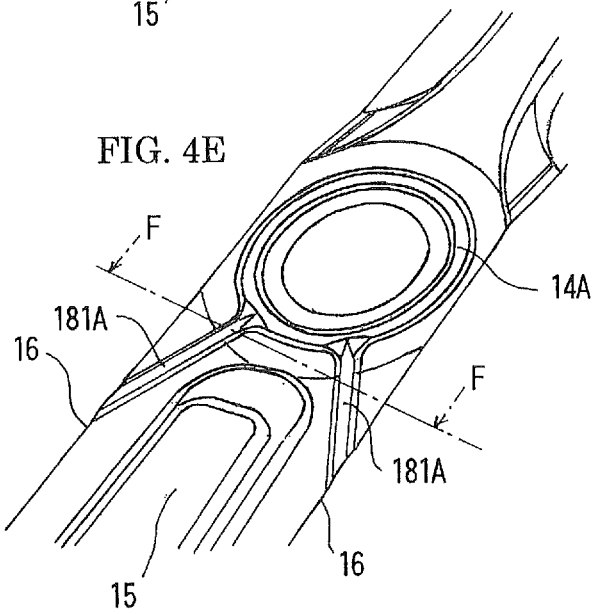
Figure 4F:
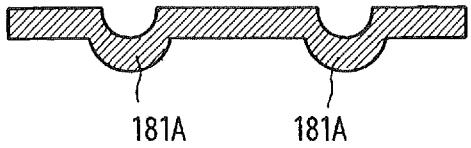
FIG. 4F is a schematic sectional view taken along line F-F of FIG. 4E.

In FIGS. 4E and 4F, two stress-dispersing elongated protrusions 181A, 181A are formed between the annular protrusion 14A and the longitudinally elongated planar protrusion 15 in such a manner as to extend from the annular protrusion 14A in respectively oblique directions with their one ends connected to the annular protrusion 14A and with their other ends reaching the respective edges 16, 16. The letter "A" in the annular protrusion 14A and the stress-dispersing elongated protrusion 181A means that they appear in a "protruding" manner on a side opposite the side on which the longitudinally elongated planar protrusion 15 appears in a protruding manner.

The stress-dispersing planar protrusions and the stress-dispersing elongated protrusions shown in FIGS. 4A to 4F also yield a stress-dispersing function in a manner substantially similar to that of the stress-dispersing elongated protrusions shown in FIGS. 1A and 1B, FIGS. 2A to 2H, and FIGS. 3A to 3J.

(5) Modifications

In the above embodiments, in the case where the stress-dispersing protrusion 18 assumes the form of the stress-dispersing elongated protrusion 181 (or 181A), the two stress-dispersing elongated protrusions 181 (or 181A) are formed in such a manner as to have one-to-one correspondence with the two edges 16. However, a plurality of elongated stress-dispersing protrusions may be formed in association with at least one edge 16, for example, in such a manner as to be parallel to one another.

In the above embodiments, the stress-dispersing elongated protrusions 181 (or 181A) are such that their one ends overlap the annular protrusion 14, whereas their other ends overlap a distal end portion of the longitudinally elongated planar protrusion 15. However, such overlap may be avoided at their one ends and/or at their other ends.

In the case where the stress-dispersing protrusions 18 are located toward the edges 16, the examples shown in FIGS. 1A and 1B, FIGS. 2A to 2H, and FIGS. 3A to 3J are described while mentioning the stress-dispersing elongated protrusions in the fowl of straight lines or curved lines. However, a stress-dispersing planar protrusion(s) may be formed in place of or mixedly with these stress-dispersing elongated protrusions. For example, in FIG. 3E, the regions enclosed by the two stress-dispersing elongated protrusions 181*e*, 181*e* and the corresponding two edges 16, 16 may assume the form of respective planar protrusions.

INDUSTRIAL APPLICABILITY

The present invention is applicable to a so-called X arm type window regulator having a lift arm and an equalizer arm and adapted to open and close, through pivotal movement of the lift arm, window glass which is supported by the lift arm via a lift arm bracket.

DESCRIPTION OF REFERENCE NUMERALS

1 a lift arm
11 a proximal end portion of a lift arm
12 a distal end portion of a lift arm
13 a through hole formed in a central portion of a lift arm
14 an annular protrusion
14A an annular protrusion (in a "protruding" manner on an opposite side of numeral 14)
15 a longitudinally elongated planar protrusion
15*a* a longitudinally elongated planar protrusion
16 an edge of a lift arm
18 a stress-dispersing protrusion
181 a stress-dispersing elongated protrusion
181A a stress-dispersing elongated protrusion (in a "protruding" manner on an opposite side of numeral 181)
185 a stress-dispersing planar protrusion
185A a stress-dispersing planar protrusion (in a "protruding" manner on an opposite side of numeral 185)
19 a driven gear
2 an equalizer arm
2A a first equalizer arm
2B a second equalizer arm
2C a plug plate
21 a proximal end portion of an equalizer arm
22 a distal end portion of an equalizer arm
23 a middle portion of an equalizer arm
5 a lift arm bracket

51 a guide of a lift arm bracket
6 an equalizer arm bracket
61 a guide of an equalizer arm bracket
8 a base plate
9 a drive mechanism
91 a motor

The invention claimed is:

1. A window regulator, comprising:

a lift arm whose one end portion is rotatably supported and whose another end portion is guided by a guide of a lift arm bracket extending in a direction intersecting with a direction of opening and closing window glass; and an equalizer arm whose middle portion is pivotally fitted into a through hole formed in a central portion of the lift arm in such a manner that the equalizer arm and the lift arm form a shape resembling a letter X, whose one end portion supports the lift arm bracket, and whose another end portion is guided by a guide of an equalizer atm bracket parallel to the guide of the lift arm bracket, the lift arm moving pivotally to open and close the window glass supported by the lift arm bracket, wherein the lift arm includes:

an annular protrusion formed around the through hole; and at least one stress-dispersing elongated protrusion formed in a region located in a vicinity of the through hole and on a side toward said one end portion of the lift arm, wherein the stress-dispersing elongated protrusion is extended in a rectilinearly oblique direction, with respect to a longitudinal direction of the lift arm, in such a manner that one end of the stress-dispersing elongated protrusion is connected to the annular protrusion, whereas another end of the stress-dispersing elongated protrusion reaches an edge of the lift atm, and wherein said another end of the stress-dispersing elongated protrusion extends to end at the edge of the lift arm.

2. A window regulator according to claim 1, wherein the lift arm includes a longitudinally elongated planar protrusion formed at a laterally central portion thereof between the annular protrusion and said one end portion of the lift arm and extending in a longitudinal direction from a proximal vicinity of the annular protrusion toward said one end portion of the lift arm.

3. A window regulator according to claim 2, wherein, in a plan view, the stress-dispersing elongated protrusion includes a part being extended to overlap, in a longitudinal direction of the lift arm, with at least one end of the longitudinally elongated planar protrusion.

4. A window regulator according to claim 3, wherein, in a plan view, the stress-dispersing elongated protrusion is overlapped, in the longitudinal direction of the lift arm, with the longitudinally elongated planar protrusion, and wherein, in a lateral direction of the lift arm, the stress-dispersing elongated protrusion is separated from the longitudinally elongated planar protrusion.

5. A window regulator according to claim 2, wherein the stress-dispersing elongated protrusion is separated from the longitudinally elongated planar protrusion.

6. A window regulator according to claim 2, wherein, in the longitudinal direction of the lift aim, the stress-dispersing elongated protrusion is overlapped with the longitudinally elongated planar protrusion.

7. A window regulator according to claim 2, wherein, in a plan view, said another end of the stress-dispersing elongated protrusion overlaps with at least one end of the longitudinally elongated planar protrusion.

8. A window regulator according to claim 1, wherein said another end of the stress-dispersing elongated protrusion is flush with the edge of the lift arm.

* * * * *